US006502677B1

(12) United States Patent
Tiramani et al.

(10) Patent No.: US 6,502,677 B1
(45) Date of Patent: Jan. 7, 2003

(54) FULL-GUSSETTED LUGGAGE AND AN ASSOCIATED METHOD OF MAKING FULL-GUSSETTED LUGGAGE

(75) Inventors: Paolo M. B. Tiramani, Greenwich, CT (US); John A. Bozak, Greenwich, CT (US); Soohyun Ham, Stamford, CT (US)

(73) Assignee: 500 Group, Inc., Greenwich, CT (US)

( * ) Notice: Subject to any disclaimer, the term of this patent is extended or adjusted under 35 U.S.C. 154(b) by 0 days.

(21) Appl. No.: 09/405,363

(22) Filed: Sep. 24, 1999

(51) Int. Cl.[7] ..... A45C 13/36; A45C 3/00; A45C 5/00

(52) U.S. Cl. ..... 190/127; 190/115; 190/18 A; 190/28; 190/25; 190/124; 190/117; 16/114.1; 16/405

(58) Field of Search ..... 16/114.1, 405, 16/429, 444; 190/107, 115, 117, 118, 28, 24, 25, 127, 124

(56) References Cited

U.S. PATENT DOCUMENTS

| | | | | | |
|---|---|---|---|---|---|
| 1,074,133 | A | * | 9/1913 | Neustaedter | 190/115 X |
| 1,149,634 | A | * | 8/1915 | Grigler | 190/115 X |
| 1,495,752 | A | * | 5/1924 | La Rue | 190/115 X |
| 2,227,266 | A | * | 12/1940 | Levin | 190/37 |
| 2,520,250 | A | * | 8/1950 | Meyers | 150/105 X |
| 2,531,302 | A | * | 11/1950 | Schwennicke | 190/107 |
| 2,617,504 | A | * | 11/1952 | Meyers | 150/105 X |
| 2,694,427 | A | * | 11/1954 | Hovis | 150/105 X |
| 2,716,473 | A | * | 8/1955 | Droutman | 190/127 |
| 2,718,943 | A | * | 9/1955 | Braveman | 190/107 |
| 3,058,554 | A | * | 10/1962 | Koren et al. | 190/28 |
| 3,068,972 | A | * | 12/1962 | Armstrong | 190/107 |
| 3,168,173 | A | * | 2/1965 | Koffler | 190/405 |
| 3,289,798 | A | * | 12/1966 | Gerrie | 190/115 X |
| 3,372,780 | A | * | 3/1968 | Fujioka et al. | 16/405 |
| 3,438,467 | A | * | 4/1969 | Milette et al. | 16/405 |
| 3,623,580 | A | * | 11/1971 | Toller | 190/115 |
| 3,845,799 | A | * | 11/1974 | Mittell | 150/105 X |
| 3,861,504 | A | * | 1/1975 | McGraw | 190/107 |
| 4,160,496 | A | * | 7/1979 | Knight | 190/107 |
| 4,733,549 | A | * | 3/1988 | Baker | 190/115 X |
| 5,107,971 | A | * | 4/1992 | Freeman | 190/26 |
| 5,234,756 | A | * | 8/1993 | Kohama et al. | 428/284 |
| 5,566,797 | A | * | 10/1996 | Van Himbeeck | 190/18 A |
| 5,566,798 | A | * | 10/1996 | Tsai | 190/115 |
| 5,613,273 | A | * | 3/1997 | Tsai | 190/115 |
| 5,782,325 | A | * | 7/1998 | O'Shea et al. | 190/115 X |
| 5,924,169 | A | * | 7/1999 | Lu | 190/115 X |
| 6,109,404 | A | * | 8/2000 | Bishop | 190/115 X |

OTHER PUBLICATIONS

Merriam Webster's Collegiate Dictionary, Tenth edition, p. 753.*

Industrial Plastics, third edition, Richardson et al.*

* cited by examiner

*Primary Examiner*—Lee Young
*Assistant Examiner*—Tri M. Mai
(74) *Attorney, Agent, or Firm*—David V. Radack; Brij K. Agarwal; Eckert Seamans Cherin & Mellott, LLC

(57) ABSTRACT

A full-gussetted luggage article and an associated method for making a full-gussetted luggage article are provided. The full-gussetted luggage article includes an integrally molded full-gusset and a skin disposed over the full-gusset. An associated method of making a full-gussetted luggage article and a unique handle assembly for a full-gussetted luggage article are also disclosed.

10 Claims, 13 Drawing Sheets

FULL-GUSSETTED LUGGAGE AND AN ASSOCIATED METHOD OF MAKING FULL-GUSSETTED LUGGAGE

BACKGROUND OF THE INVENTION

This invention relates to improvements in full-gussetted luggage and an associated method of making full-gussetted luggage.

Full-gussetted soft-sided luggage typically involves providing a gusset and surrounding that gusset with a fabric skin. The fabric skin includes a zippered portion which defines a flap which acts as the lid to allow access into the interior of the luggage piece. Because the fabric skin must cover the full-gusset and because the opening provided in the skin for inserting the full-gusset therein is smaller than the full-gusset itself, the full-gusset is usually provided in pieces and then must be constructed inside the skin. This construction process is labor intensive and requires manual dexterity. In addition, several parts must be available for assembly, so inventory problems can sometimes arise when parts are missing or defective. Currently, a full-gusset is made of several dozen components.

What is needed is a full-gussetted luggage article that is easy to assemble and manufacture, but which still provides the necessary rigidity and functionality of prior art full-gussetted luggage articles.

SUMMARY OF THE INVENTION

The invention has met the above-mentioned needs, as well as others. A luggage article is provided which comprises an integrally formed full-gusset and a fabric skin disposed over the full-gusset. Preferably, the full-gusset includes a hingedly mounted portion and at least one resilient portion which permits the full-gusset to be inserted through an opening in the fabric skin during manufacture of the luggage article. Once inserted, the full-gusset reforms in the fabric skin in order to form the luggage article. An associated method of making a luggage article using the above-mentioned full-gusset and a unique handle assembly for a full-gussetted luggage article are also disclosed.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
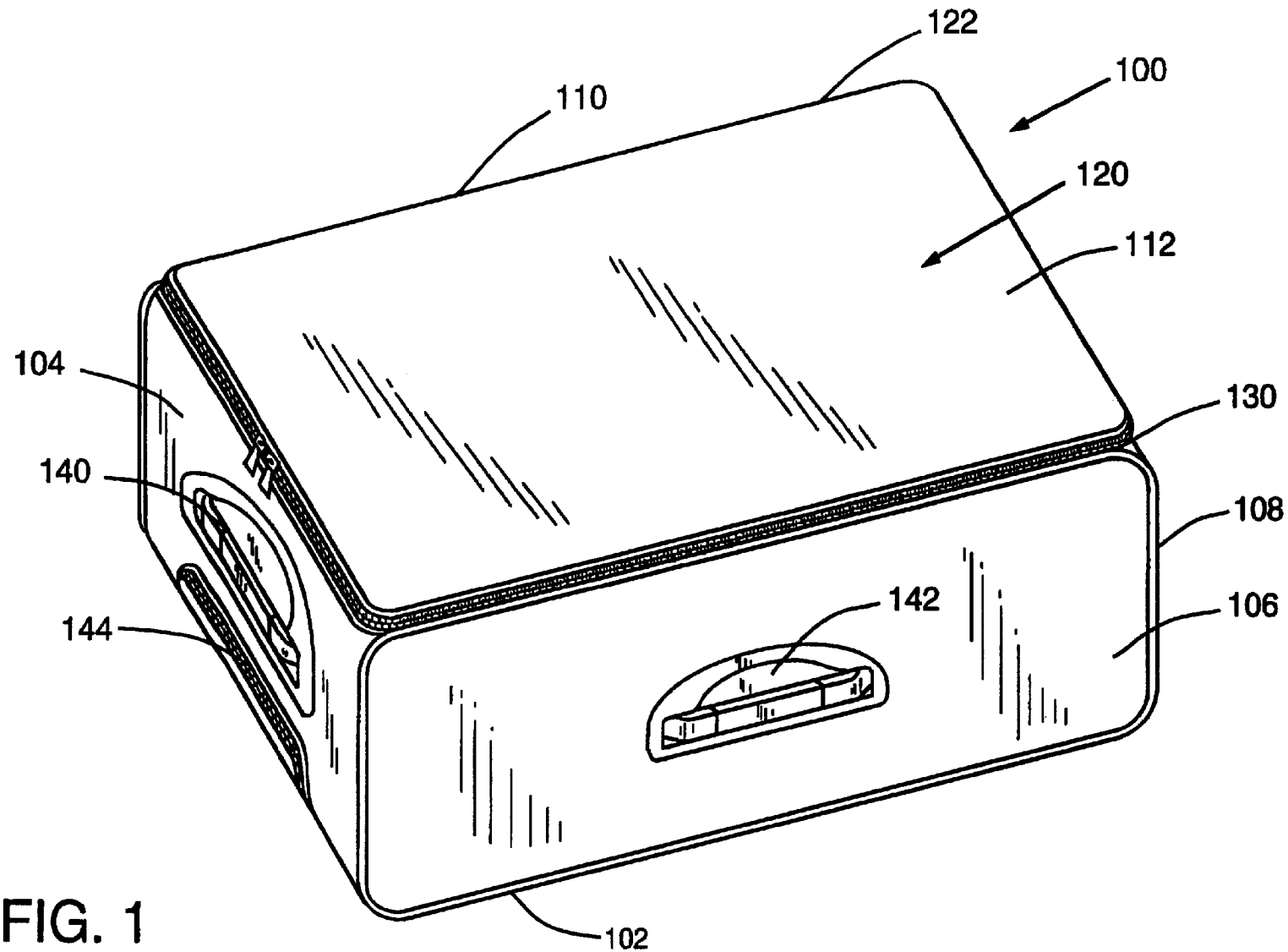
FIG. 1 is a perspective view of the full-gussetted luggage article of the invention.
Figure 2:
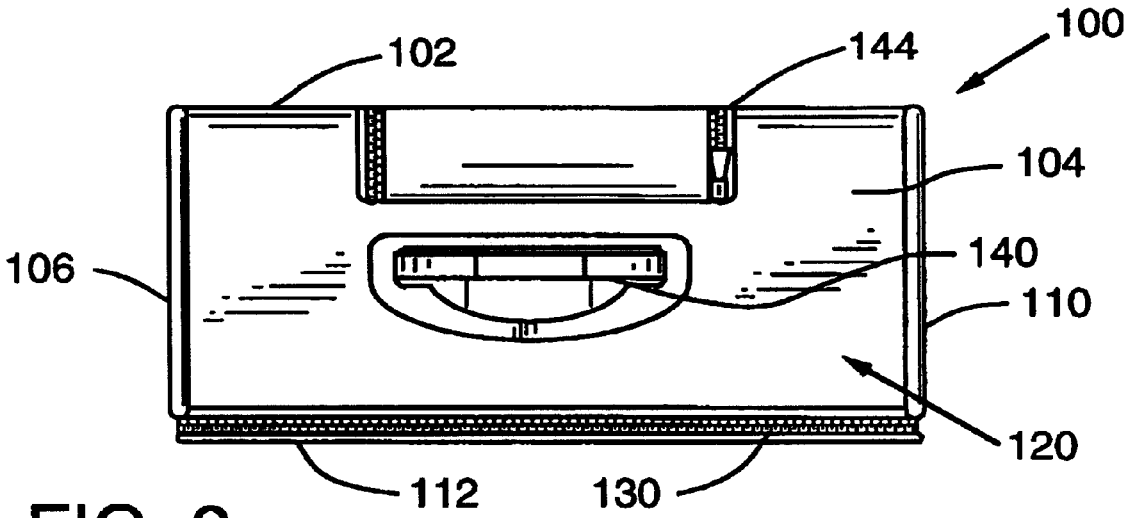
FIG. 2 is a top plan view of the luggage article of FIG. 1.

Referring now to FIGS. 1–7, a full-gussetted luggage article 100 is shown. The luggage article 100 appears; from the outside, to look like a conventional full-gussetted piece, and includes a base 102, four sidewalls 104, 106, 108 and 110 and a lid 112. As is known, and as characterizes a full-gussetted luggage article, a skin 120 made of vinyl or cloth covers a full-gusset (not seen in these views) to form the base 102 and the four sidewalls 104, 106, 108 and 110. The lid 112 is merely an extension of the skin 120 and is attached by a seam 122 to one portion of the skin 120 and is provided with a zipper 130 to allow the luggage article 100 to be opened and closed.

It will be appreciated that various outside pockets (zippered or non-zippered) can be provided on the luggage article 100. As those features are well known and do not form any part of this invention, they are not shown.

Two separate, but identical, handle assemblies 140 and 142 are shown disposed on sidewalls 104 and 106, respectively. These handle assemblies 140 and 142 permit hand-carrying of the luggage article 100. The handle assemblies 140 and 142 are unique and are a part of the invention and will be explained in detail with respect to FIGS. 15–17.

The luggage article 100 is also provided with a pull handle and wheel assembly. The pull handle is accessed through a zippered compartment 144 (see FIGS. 1, 2 and 6). It will be appreciated that any pull handle assembly can be used for the luggage article 100 of the invention, or, if preferred, none at all. If a pull handle assembly is used, the luggage article 100 will include a pair of molded wheel assemblies 146 and 148, as shown in FIGS. 3–6. It will be appreciated that the wheel assemblies 146 and 148 are disposed in complementary wheel assembly openings in the full-gusset, which will be described below with respect to FIGS. 9 and 10. The wheel assemblies 146 and 148 are disposed on the exterior of the skin 120 and are secured with fasteners (such as rivets) which extend through the skin 120 and which are attached to the full-gusset. This arrangement will facilitate securing the skin 120 to the full-gusset.

Figure 3:
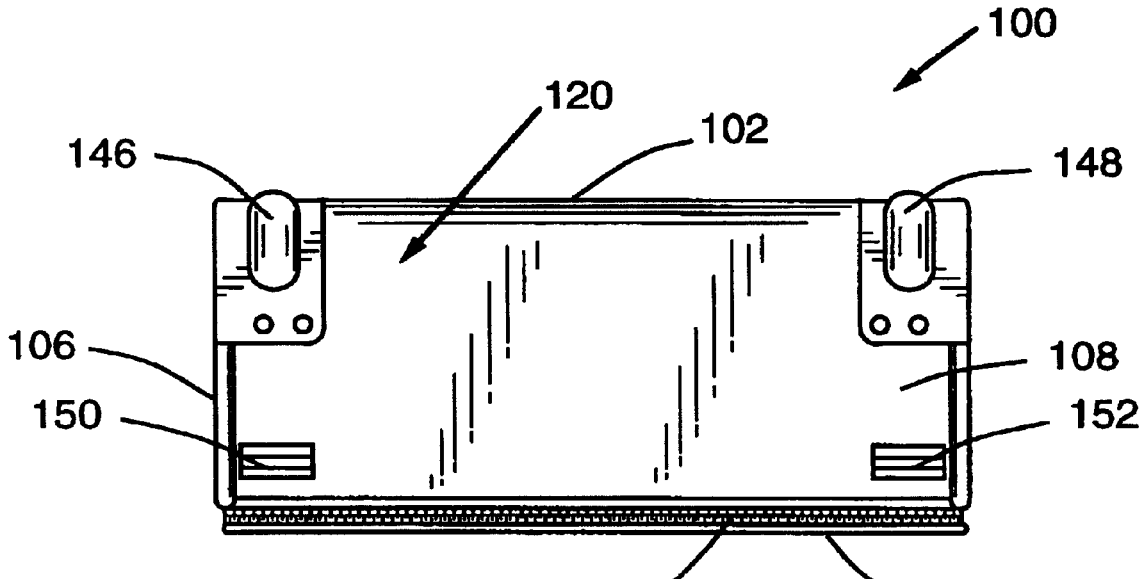
FIG. 3 is a bottom plan view of the luggage article of FIG. 1.
Figure 4:
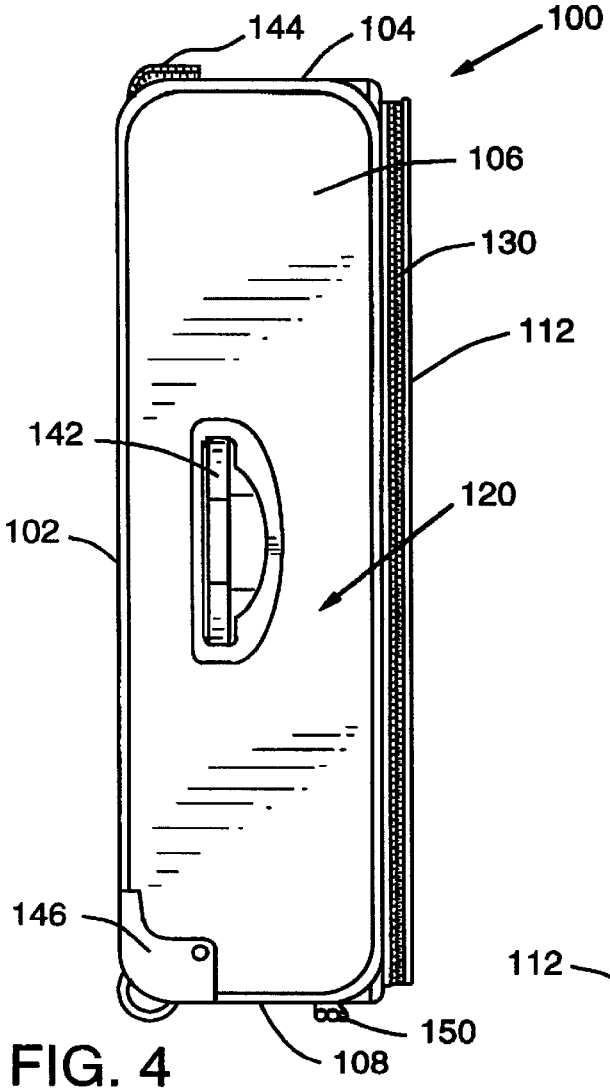
FIG. 4 is a front elevational view of the luggage article of FIG. 1.
Figure 5:
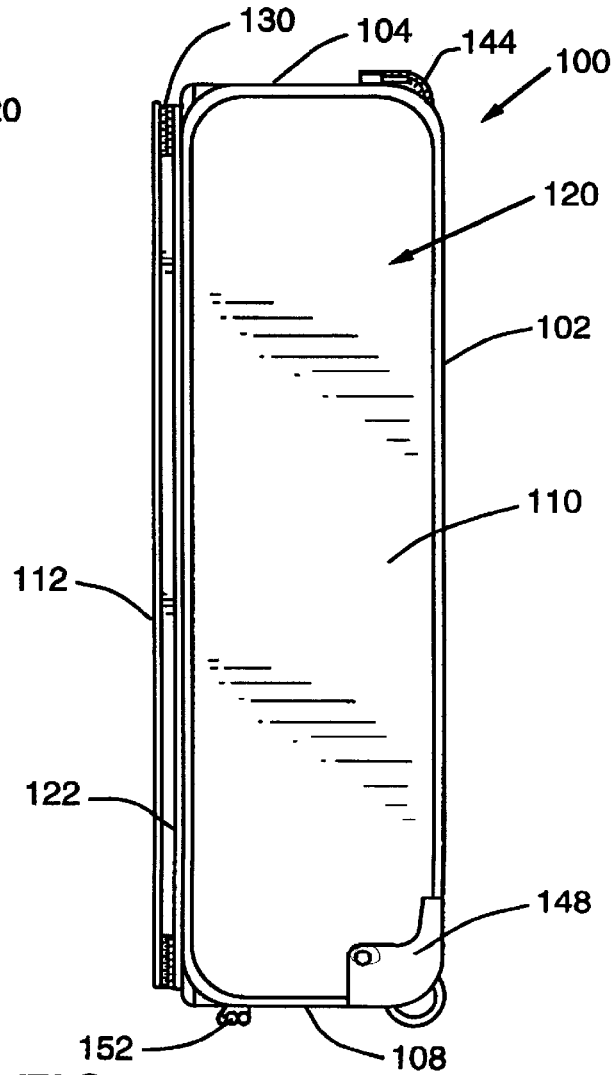
FIG. 5 is a back elevational view of the luggage article of FIG. 1.
Figure 7:
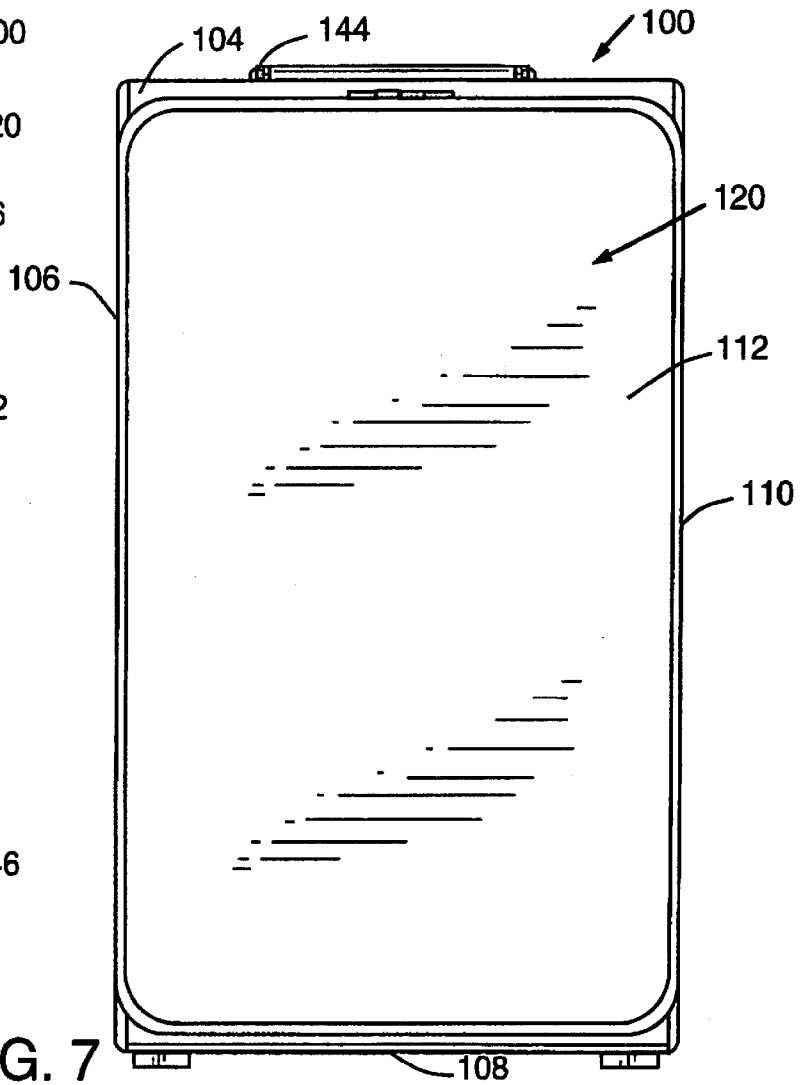
FIG. 7 is a right side elevational view of the luggage article of FIG. 1.

The luggage article 100 can also include padded feet members 150, 152 on the bottom sidewall 108, as can be seen in FIGS. 3–5.

Figure 6:
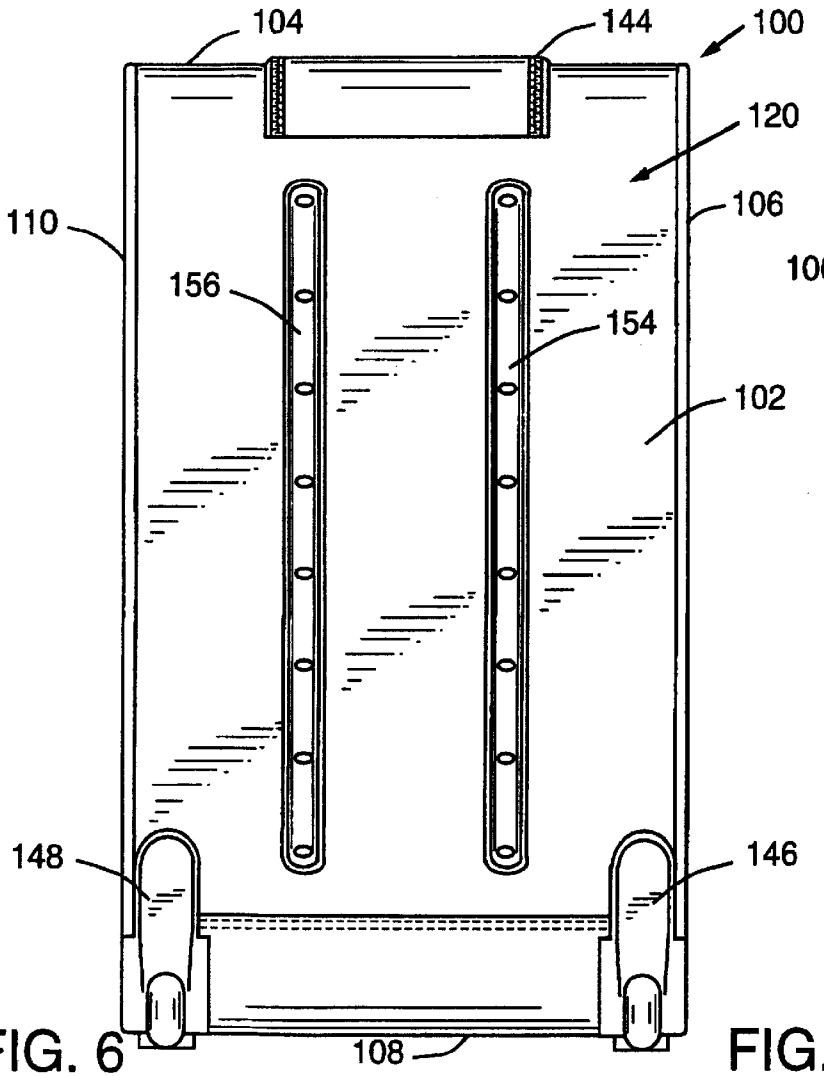
FIG. 6 is a left side elevational view of the luggage article of FIG. 1.

The skin 120 is also secured to the full-gusset by mounting strips 154, 156 disposed on the exterior of the skin 120 adjacent to the base 102, as can be seen in FIG. 6. This aspect of the luggage article 100 will be explained below with respect to FIGS. 9–12.

Figure 8:
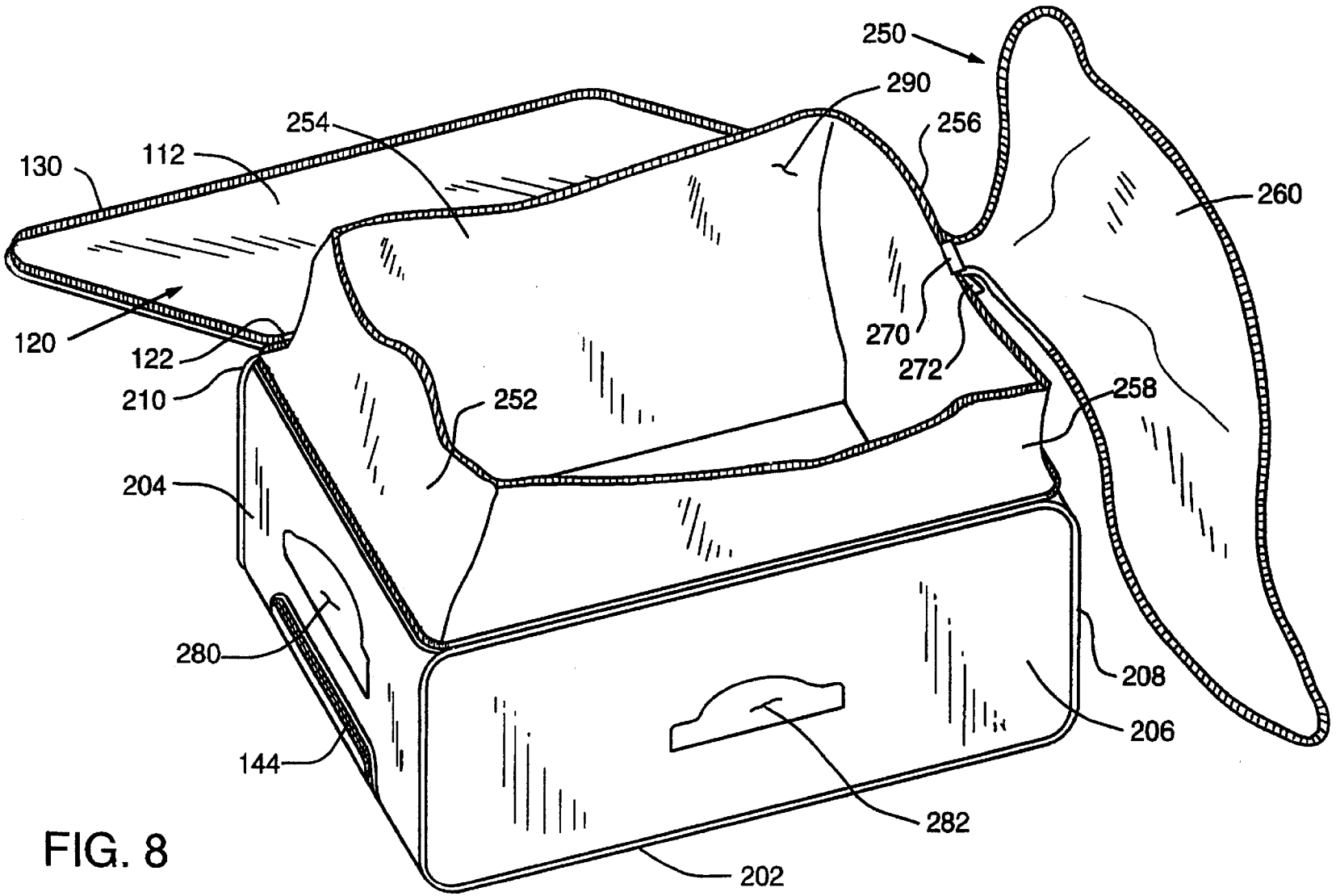
FIG. 8 is a perspective view of the skin only.

FIG. 8 shows a view of the skin 120 before the full-gusset of the invention is inserted therein. The skin 120 includes a base section 202; a top sidewall section 204; left sidewall section 206; a bottom sidewall section 208; and a right sidewall section 210. A lid section 112 is provided, and as was explained with respect to FIGS. 1–7, the lid section 112 is permanently secured to the right sidewall section 210 by means of a seam 122. The lid section 112 is also provided with a zipper 130.

The skin 120 also includes an internal lining portion 250 having flaps 252, 254, 256 and 258, along with a flap 260 which is permanently attached to flap 256 by means of seam 270 and also removably attached to all of the other flaps by means of a zipper 272. The purpose of the lining portion 250 is to cover the full-gusset once it is placed into the skin 120, as will be explained with respect to FIG. 11. The skin 120 also includes handle assembly openings 280 and 282 for receiving handle assemblies 140 and 142, respectively.

Figure 9:
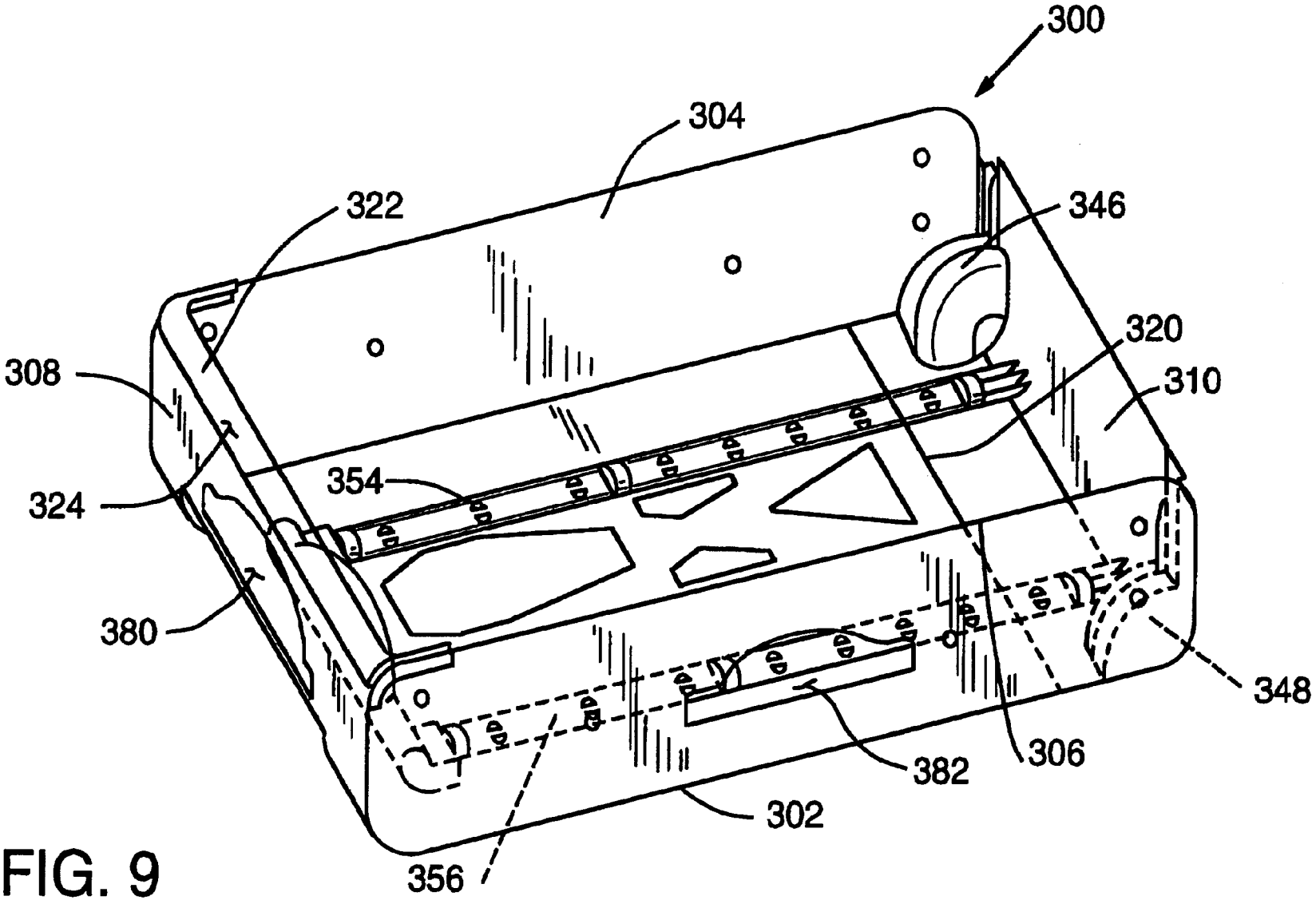
FIG. 9 is a front perspective view, partially in phantom, of the full-gusset only of the invention which is part of the luggage article shown in FIG. 1.
Figure 10:
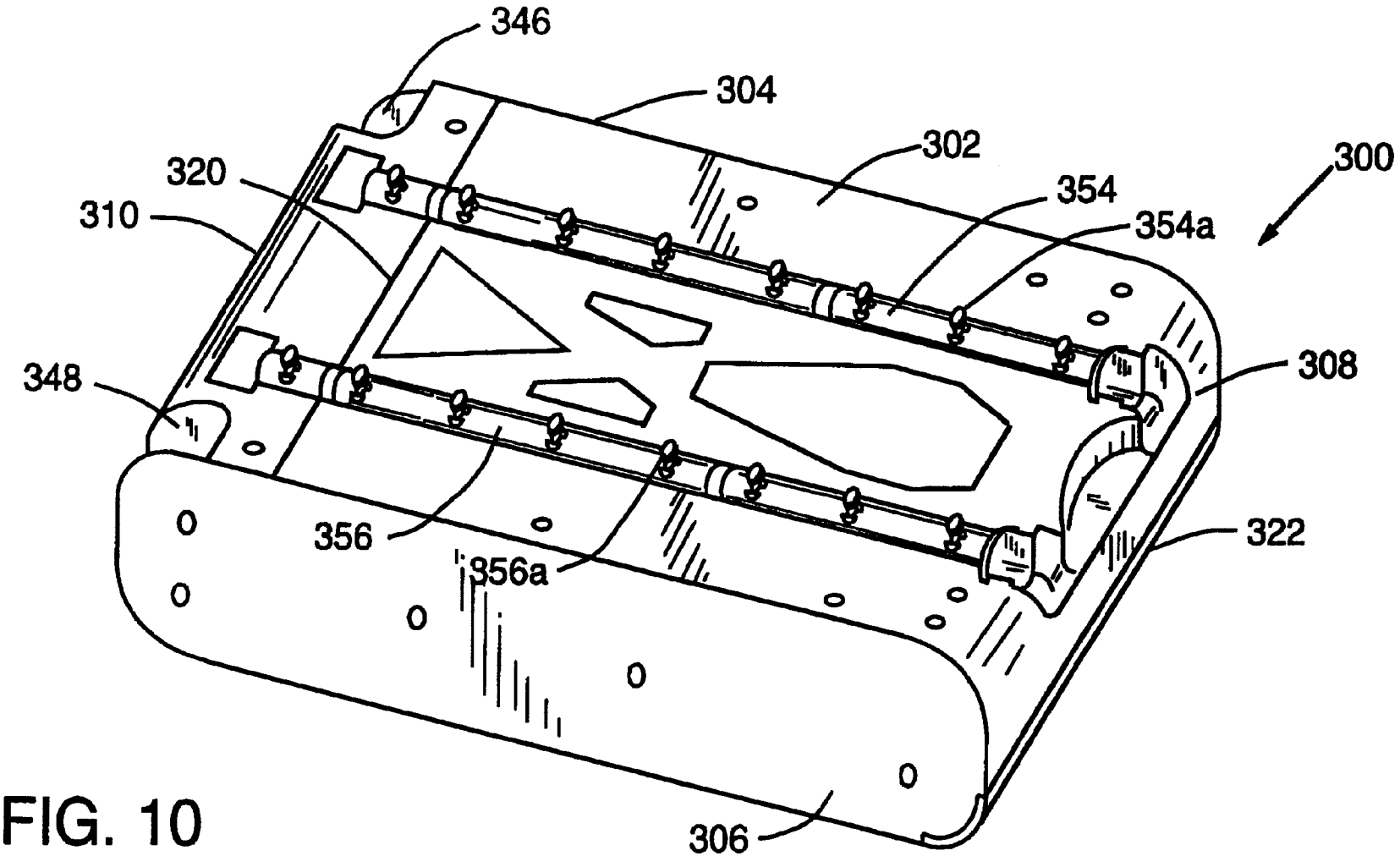
FIG. 10 is a back perspective view of the full-gusset shown in FIG. 9.

The full-gusset 300 of the invention is shown in FIGS. 9 and 10. The full-gusset is preferably made of plastic and is integrally molded as one piece by, preferably, an injection molding process as opposed to prior art full-gussets which must be assembled inside the skin. The integral design means that all fasteners and anchor points are integrally formed with the full-gusset thus reducing the number of components needed which in turn not only reduces the cost but which also increases the strength of the full-gusset. Because of this, the defect rate is substantially lowered due to less componentry location error. In addition, because less suppliers are needed, component inventories are reduced. All of these factors contribute towards a higher quality item at a lower cost, which reduces returns and increases customer satisfaction.

Referring now specifically to FIGS. 9 and 10, the full-gusset 300 includes a base 302 and two long sidewalls 304 and 306. A front cup 308 and a back cup 310 are also provided. The back cup 310 includes a living hinge line 320, which allows the back cup 310 to be folded inwardly, the purpose of which will be explained with respect to FIG. 11. The front cup 308 also preferably includes a hinged flap portion 322. This hinged flap portion 322 provides an undercut space 324 which facilitates racking of items in the luggage article once assembled. The hinged flap portion 322 allows the full-gusset to be integrally molded without the need for expensive slides in the molding process while at the same time providing the undercut space for racking as mentioned above.

Figure 10A:
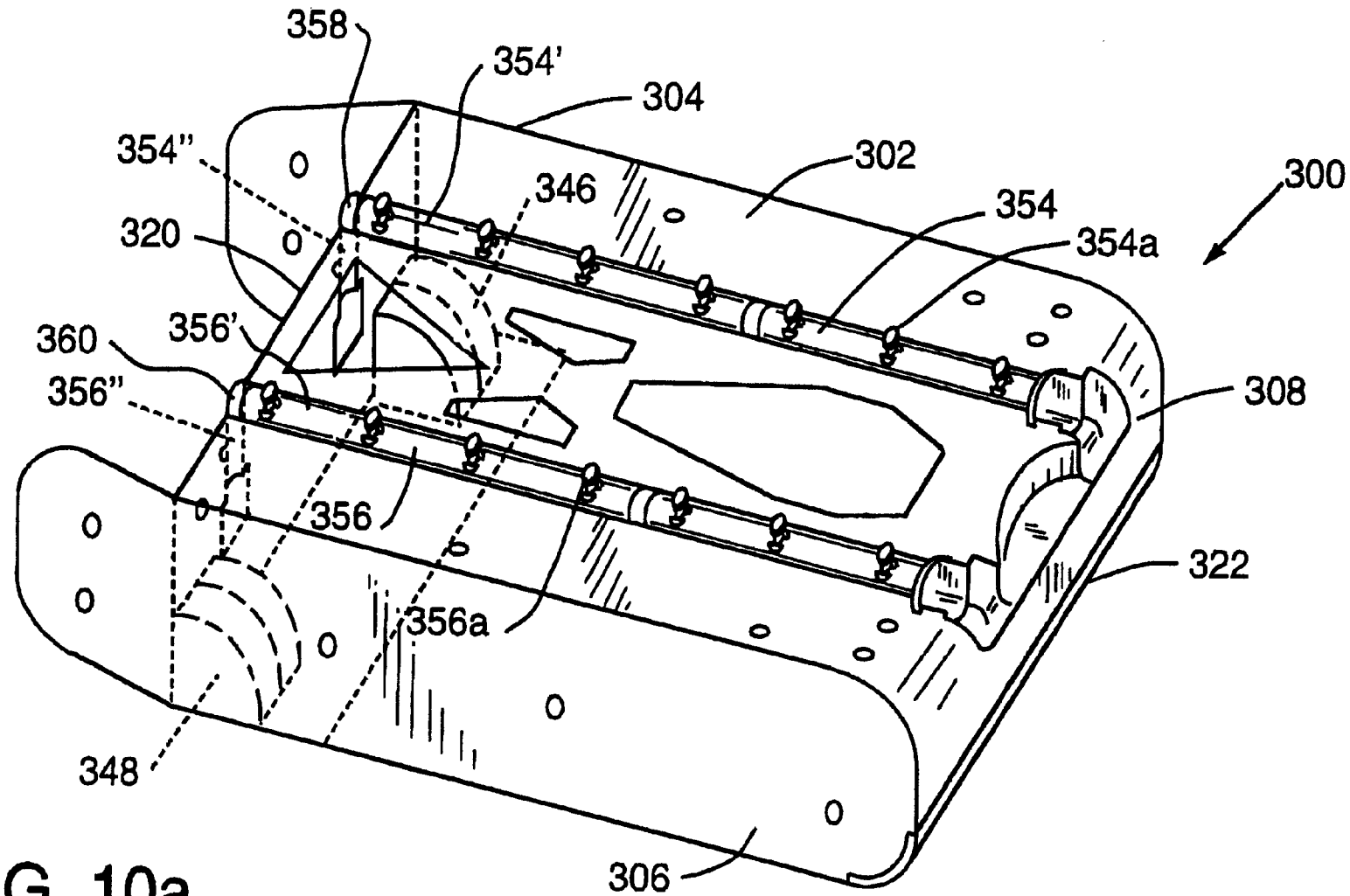
FIG. 10A is a partial view of FIG. 10 only showing the back cup of the gusset being bent inwardly.

Referring to FIGS. 10 and 10A, the back cup 310 is shown being bent inwardly along hinge line 320. It will be appreciated that mounting channels 354 and 356 are separated into two portions 354' and 354" and 356' and 356" with spaces 358 and 360 defined therebetween to allow the back cup 310 to bend inwardly along hinge line 320 as shown in FIG. 10A.

The full-gusset 300 includes molded wheel wells 346 and 348 which are adapted to receive wheel assemblies 146 and 148. In addition, integrally molded, internal mounting channels 354 and 356, each including a series of integrally molded mounting tabs 354*a* and 356*a*, are also provided. The mounting channels 354 and 356 receive the separate bars (not shown) of the pull handle assembly and the mounting tabs 354*a* and 356*a* are used to secure the skin to the full-gusset 300. The full-gusset 300 also includes handle assembly openings 380, and 382 (FIG. 9) for receiving handle assemblies 140 and 142, respectively.

The plastic material used to make the full-gusset can be a clear or translucent material with or without metal, carbon or glass particles introduced into the resin to create impact strength to prevent cracking. The benefit of using this clear or translucent material is that when the full-gusset is molded, stress fractures, weaknesses, defects and/or cracks can be easily visually inspected thus increasing quality control.

Figure 11:
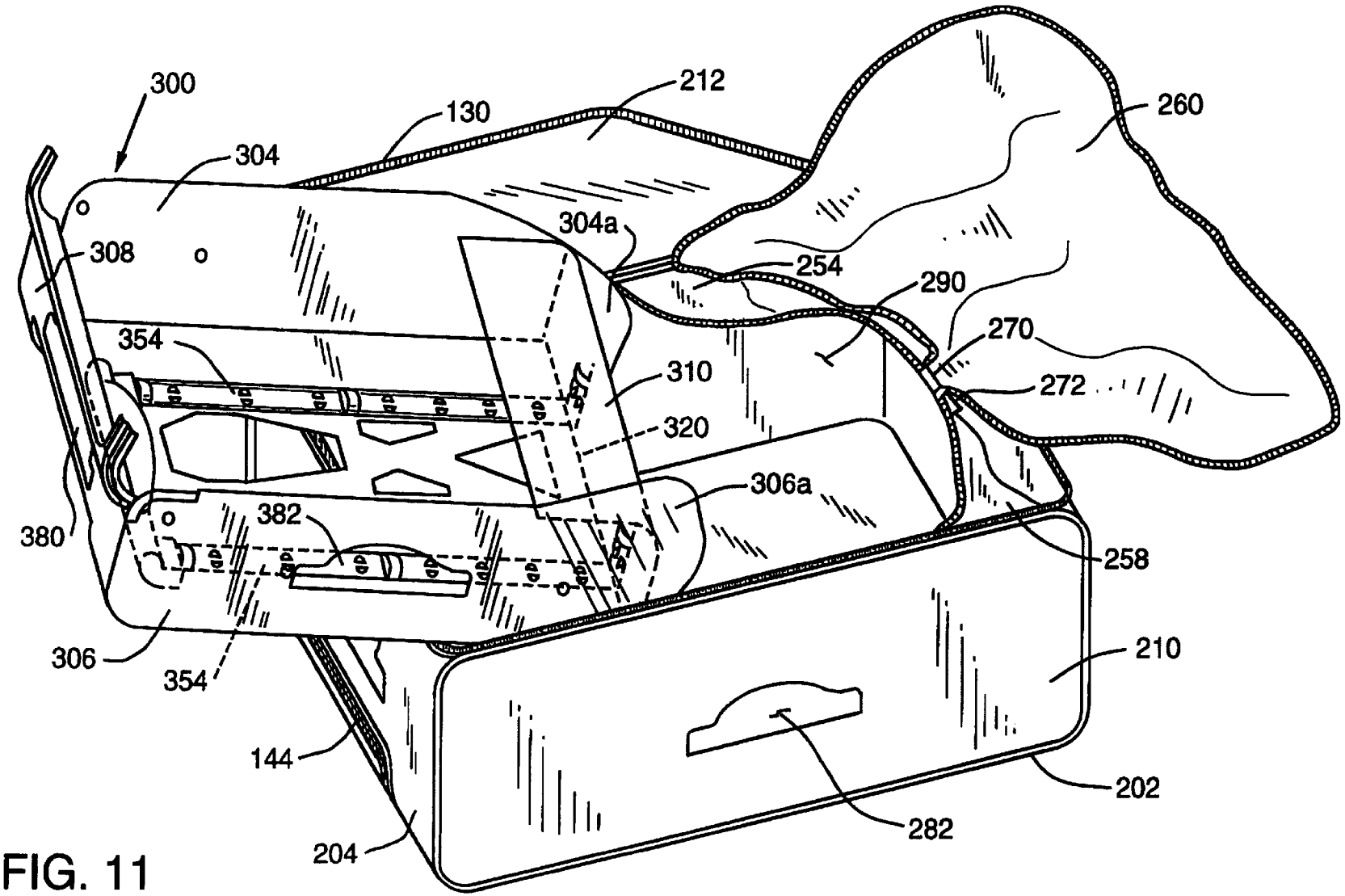
FIG. 11 is an exploded perspective view showing how the full-gusset is inserted into the opening in the skin.
Figure 12:
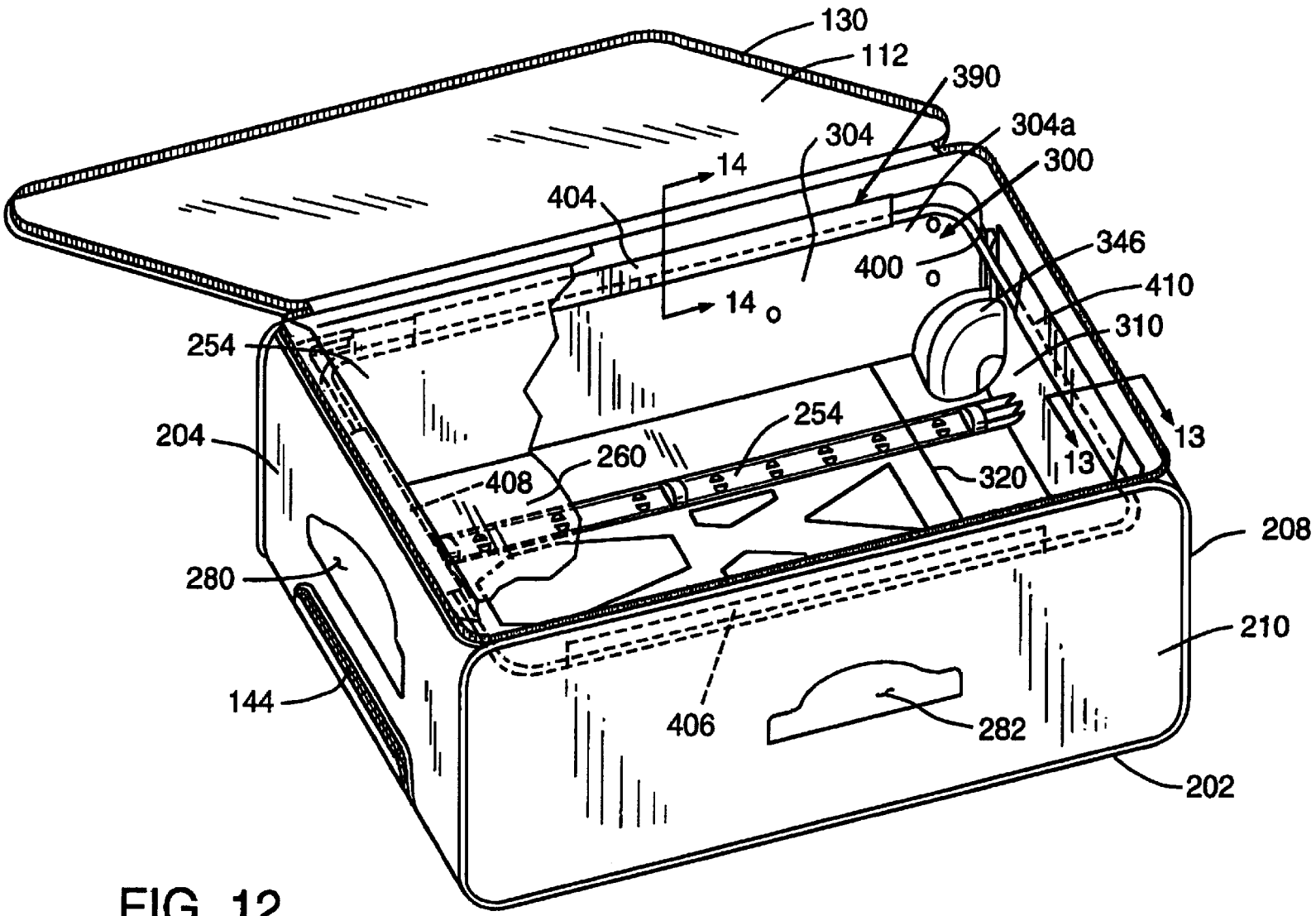
FIG. 12 is a perspective view, partially cutaway, of the luggage article showing the reinforcing member of the invention.

Referring now to FIG. 11, the assembly of the luggage article 100 will be explained. The flaps of the skin define an opening 290 through which the full-gusset 300 must be inserted. Because this opening 290 was too small to allow the full-gusset of the prior art to be inserted therein as one piece, the prior art taught that the full-gusset must be made in separate pieces, and must be assembled inside the skin. The invention herein has solved this problem by providing an integral, one-piece full-gusset 300 that has the capability to deform so that it may be placed through the opening 290 into the fabric skin 120, and then reform to provide the structure of a conventional full-gusset. A preferred structure for the full-gusset that fulfills this function is the full-gusset 300. Specifically, the front cup 310, by means of the living hinge 320, is folded inwardly and then a portion of one or preferably both of a section 304*a* and 306*a* of long sidewalls 309 and 306, respectively, are bent inwardly as shown in FIG. 11. The sections 304*a* and 306*a* can be folded inwardly due to the resilient nature of the molded plastic material that forms the full-gusset 300. The folding inwardly of the front cup 310 and the bending of one or both of the sections 304*a* and 306*a* allows the full-gusset 300 to be inserted into the opening 290 of the skin 120. Once fully inserted therein, the resilient sections 304*a* and 306*a* spring back to their original shape, and the front cup 310 is also pivoted, along hinge line 320, to its original position as shown in FIG. 12. As can be appreciated, this allows the full-gusset to be inserted into the fabric skin 120 as a one-piece, integral unit, thus avoiding the need to assemble pieces of a full-gusset in the skin, as was done in the prior art.

Figure 13:
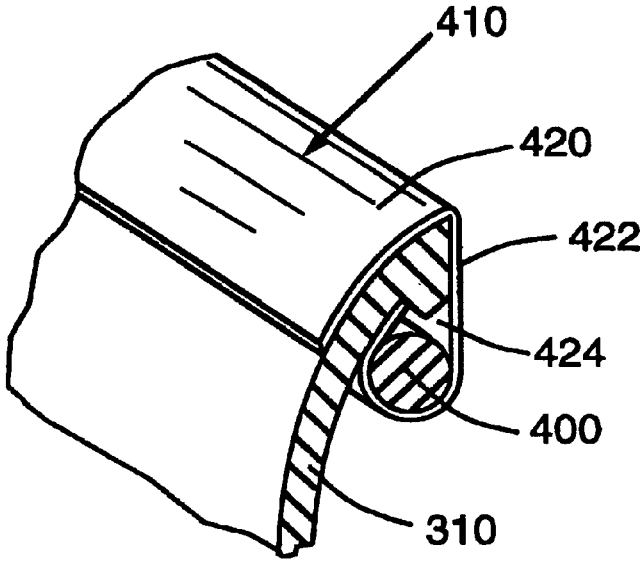
FIG. 13 is a cross-sectional view taken along line 13—13 of FIG. 12.
Figure 14:
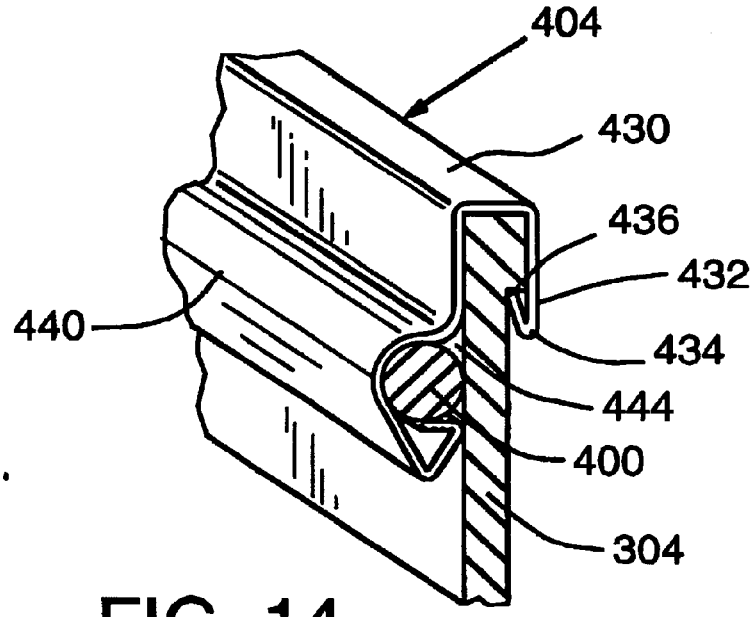
FIG. 14 is a cross-sectional view taken along line 14—14 of FIG. 12.

Once the full-gusset 300 is inserted into the skin 120, it is preferred, but not essential to the basic concept of the invention, to provide reinforcement means 390 to the full-gusset 300 in order to enhance rigidity of the luggage article 100. One preferred reinforcement means is shown in FIGS. 12–14. The reinforcement means includes a single metal bar 400, having a circular cross-section, which is disposed around the perimeter of the full-gusset 300. The bar 400 is attached to four separate clips 404, 406, 408 and 410, with clip 404 being attached to long sidewall 304 of the full-gusset 300; clip 406 being attached to long sidewall 306 of the full-gusset 300; clip 408 being attached to front cup 308; and clip 410 being attached to back cup 310.

Clip 410 is shown in cross-section in FIG. 13. It includes a curved flange portion 420 and a J-shaped portion 422, including a space 424 for receiving the bar 400 therein. The bar 400 can be secured in space 424 by means of an adhesive. Clip 408 is similar in structure to clip 410. Clip 404 is shown in cross-section in FIG. 14. It includes a generally U-shaped flange portion 430 having a free end 432 that includes a barb 434 which is adapted to engage an undercut space 436 defined by the long sidewall 304. The clip 404 further includes a generally C-shaped portion 440 that defines a space 444 that is adapted to receive the bar 400. The bar 400 can be secured in space 444 by means of an adhesive. Clip 404 is generally similar in structure to clip 406.

It will be appreciated that the reinforcement means, which includes the bar 400 and all four clips 404, 406, 408 and 410, can be provided as one unit, which can be clipped onto the full-gusset 300 as a unit once the full-gusset 300 is placed into the fabric skin 120. This will save assembly time while providing the desired rigidity for the luggage article 100.

Figure 15:
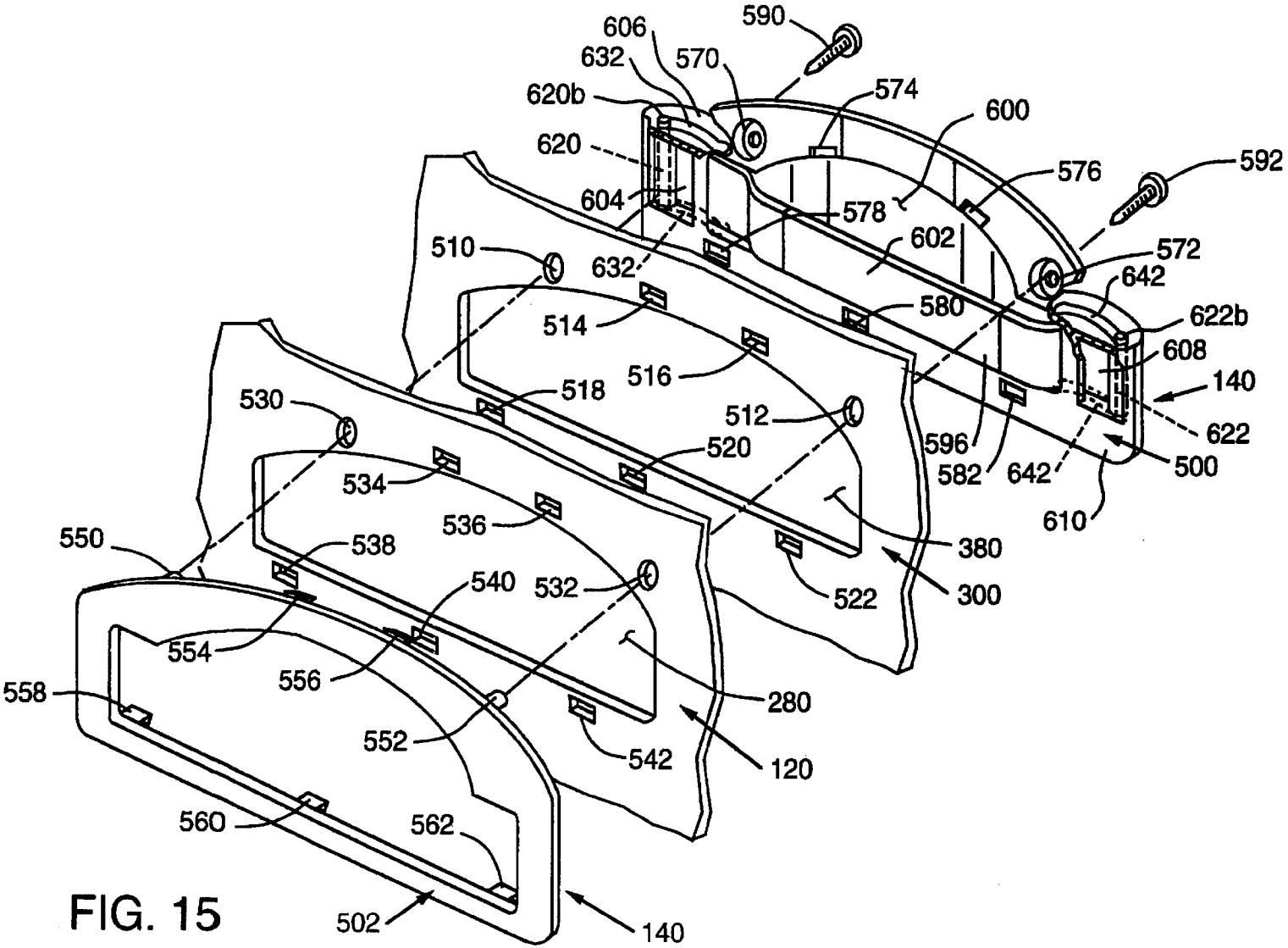
FIG. 15 is a front exploded perspective view, partially cutaway, of the handle assembly of the invention.
Figure 16:
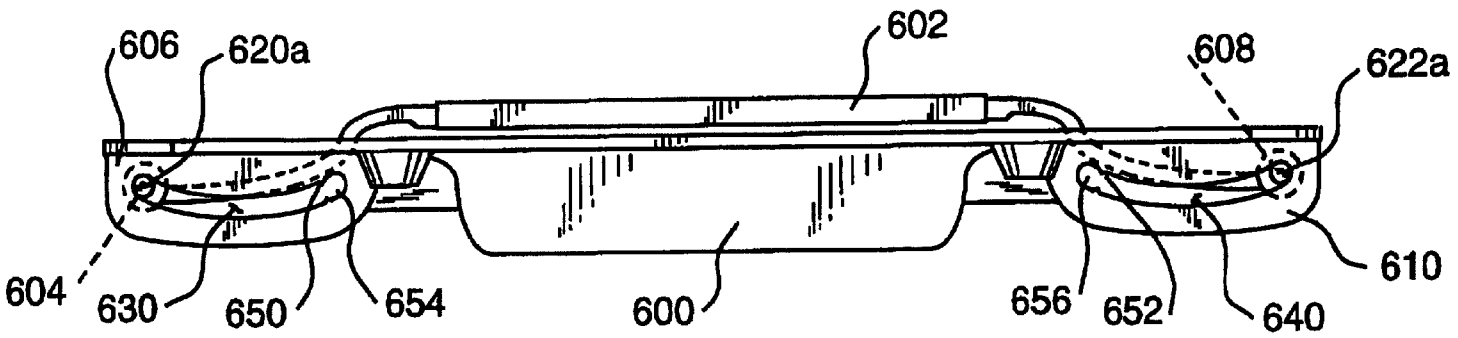
FIG. 16 is an elevational view of part of the handle assembly, showing the carrying strap in the retracted position.

Referring now to FIG. 15, the handle assembly of the invention will be described. FIG. 15 shows handle assembly 140, although it will be appreciated that handle assembly 142 has an identical structure. The handle assembly 140 includes two parts, a handle portion 500 and a bezel 502. As can be seen in FIG. 16, the gusset 300 includes the handle assembly opening 380 along with screw holes 510 and 512 and tab openings 514, 516, 518, 520 and 522. The skin 120 includes the handle assembly opening 280 along with screw holes 530 and 532 and tab openings 534, 536, 538, 540 and 542. The handle assembly 140 is assembled by aligning the handle portion 500 with the openings 380 and 280 and then attaching the bezel 502, which includes threaded screw receiving portions 550 and 552 along with tabs 554, 556, 558, 560 and 562 to the handle portion 500. The handle portion 500 includes complementary screw hole openings 570 and 572 along with tab openings 574, 576, 578, 580 and 582. It will be appreciated that tabs 554, 556, 558, 560 and 562 of the bezel 502 extend (i) through tab openings 534, 536, 538, 540, 542 of the fabric skin 120; (ii) then through tab openings 514, 516, 518, 520 and 522 of the full-gusset 300 and (iii) finally into tab openings 574, 576, 578, 580 and 582 of the handle portion 500. After this, screws 590 and 592 are (i) extended through screw hole openings 570 and 572 of the handle portion 500; (ii) then extended through screw holes 510 and 512 of the full-gusset and screw holes 530 and 532 of the skin 120 and (iii) finally received in threaded screw receiving portions 550 and 552 of the bezel 502.

It will be appreciated that the handle assembly 140 of the handle portion 500 is attached to the inside surface of the full-gusset 300 and the bezel 502 is attached to the outside surface of the skin 120. The advantage of this structure is that the handle portion 500 can not be "pulled off" of the luggage article 100, as with conventional handle assemblies that are merely bolted on to the outside surface of the luggage article. The bezel 502 also provides a means for further securing the skin 120 to the full-gusset 300. Another advantage of this assembly is that the carrying handle 602 of the handle portion 500 can be substantially flush with surface of the luggage article 100, thus preventing the handle strap 596 from getting caught on machinery or other protrusions during use and baggage handling.

Figure 17:
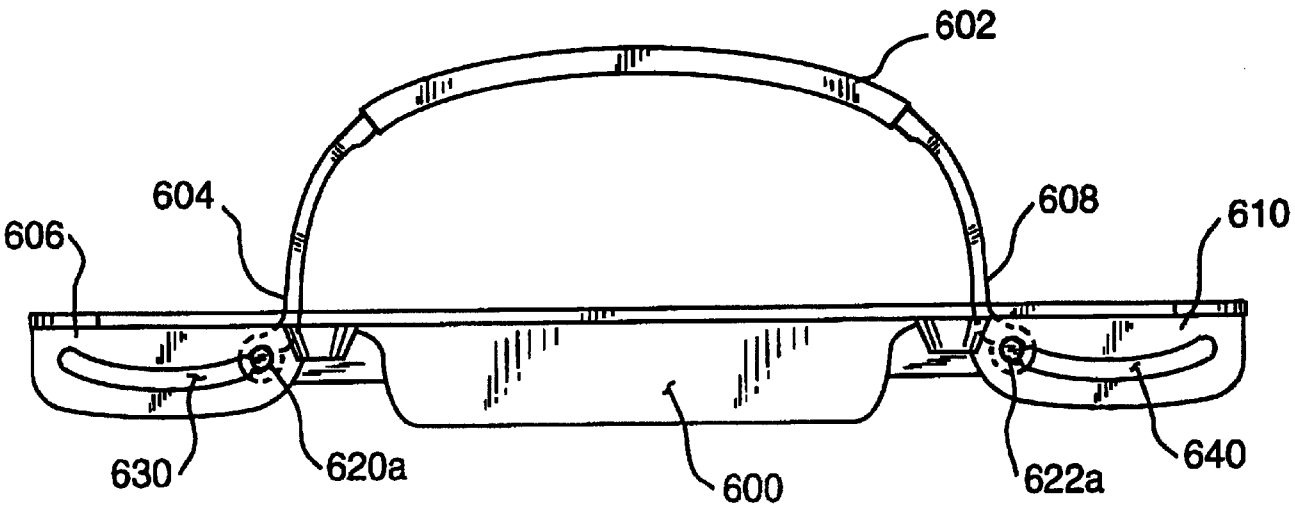
FIG. 17 is an elevational view of part of the handle assembly, showing the carrying strap in the extended position.

Referring again to FIG. 15, it will be seen that the handle portion 500 defines a hand well 600 and a carrying handle 602. The carrying handle 602 includes a first end 604 mounted in a first end section 606 of the handle portion 500 and a second end 608 mounted in a second end section 610. As can be seen in FIGS. 16 and 17, the carrying handle 602 can move from a retracted position (FIG. 16) to an extended position (FIG. 17). One structure for accomplishing this movement is to provide the first end 604 with a rod 620 that protrudes from opposing sides of the first end 604 of the carrying handle 602 and to provide a similar rod 622 that protrudes from opposing sides of the second end 608, as can be seen in the cutaway view of FIG. 15.

The ends of rod 620 (ends 620*a* and 620*b*) extend into opposed preferably accurately shaped slots 630 and 632 defined by the first end section 606 of the handle portion 500. The ends of rod 622 (ends 622*a* and 622*b*) extend into opposed preferably accurately shaped slots 640 and 642 of the second end section 610 of the handle portion 500.

In order to move the carrying handle 602 from the retracted position (FIG. 16) to the extended position (FIG. 17) the user merely lifts the carrying handle 602 away from the hand well 600. The rods 620 and 622 then move in the slots 630, 632 and 640, 642, respectively, to the position shown in FIG. 17. Another feature of the invention is the provision of detents in the slots, as can best be seen in FIG. 16. The detents 650 and 652 (along with complementary detents in the opposite side of the handle portion 500, which are not shown) provide a narrow channel 654 and 656 through which the rods 620 and 622 are forced. Once the rods 620 and 622 are in the position shown in FIG. 17, the rods 620 and 622 are prevented from inadvertently moving in the slots and thus the carrying handle 602 remains in the extended position as shown in FIG. 17. Once it is desired to move the carrying handle 602 back into the retracted position (FIG. 16) the user merely pushes down on the carrying handle 602 which forces the rods 620 and 622 past their respective detents which in turn allows free movement of the rods 620 and 622 in the slots.

It will be appreciated that a full-gussetted luggage article is provided which is easier and thus more inexpensive to manufacture than prior art full-gussetted pieces. An improved reinforcement means and an improved handle assembly are also provided.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A luggage article comprising:

an integrally formed full-gusset made of a plastic material;

a fabric skin disposed over said full-gusset to form said luggage article;

said full-gusset including (i) a hingedly mounted cup and (ii) at least one resilient portion that can deform so as to enable said full-gusset to be inserted through an opening in said skin;

said full-gusset including a bottom wall and a sidewall, said sidewall defining a top opening; and wherein said full-gusset includes a reinforcing member that is attached to said full-gusset after said full-gusset is inserted through said opening in said fabric skin.

2. The luggage article of claim 1, wherein said reinforcing member includes at least one clip and a bar, said clip being attached to an edge of said sidewall.

3. The luggage article of claim 2, wherein said bar extends around a perimeter of said full-gusset.

4. The luggage article of claim 3, wherein said sidewall includes a flange portion, said clip being attached to said flange portion.

5. The luggage article of claim 4, wherein said bar has a circular cross-section.

6. The luggage article of claim 5, wherein said full-gusset having a generally rectangular top opening including four sidewalls; and said reinforcing member includes four clips, each clip being attached to one of said sidewalls.

7. A luggage article comprising:

an integrally formed full-gusset made of a plastic material, said full-gusset including a handle assembly opening;

a fabric skin disposed over said full-gusset to form said luggage article;

a handle assembly including a bezel and a handle portion;

said bezel including a bezel opening corresponding generally in size and location to said handle assembly opening of said full-gusset;

said handle portion including a hand well and a carrying handle, wherein said bezel is attached to an outside surface of said luggage article and said full-gusset and said handle portion is attached to an inside surface of said full-gusset so that said carrying handle is accessible to a user through said bezel opening and said handle assembly opening;

said carrying handle being movable from a retracted position to an extended position;

said handle section including means for locking said carrying handle in said extended position;

wherein said means for locking said carrying handle in a carrying position comprises:

said carrying handle including a first end and a second end;

said handle section including a first end section and a second end section;

said first end section including a pair of opposed slots and said second end section also including a pair of opposed slots;

said first end of said carrying handle including a first rod that extends through said pair of opposed slots of said first end section;

said second end of said carrying handle including a second rod that extends through said pair of opposed slots of said second end section;

said first rod is movable in said pair of opposed slots in said first end section and said second rod is movable in said pair of opposed slots in said second end section; and each of said slots including a detent, wherein when said carrying handle is moved from said retracted position to said extended position, said first rod and said second rod are moved in said respective pairs of opposed slots past said detents, said detents resisting movement of said first rod and said second rod and thus said carrying handle back into said retracted position.

8. The luggage article of claim 7, wherein said slots are generally arcuate in shape.

9. A luggage article comprising:

a gusset including a gusset handle assembly opening;

a skin disposed over said gusset, said skin including a skin handle assembly opening; and a handle assembly including (i) a bezel having a bezel opening corresponding generally in size and location to said skin handle assembly opening and (ii) a handle section including a hand well and a carrying handle, wherein said bezel is attached to an outside surface of said luggage article and said gusset and said handle section is attached to an inside surface of said gusset so that said carrying handle is accessible to a user through said bezel opening and said handle assembly opening;

said carrying handle being movable from a retracted position to an extended position; and said handle section including means for locking said carrying handle in said extended position;

wherein said means for locking said carrying handle in said extended position comprises:

said carrying handle including a first end and a second end;

said handle section including a first end section and a second end section;

said first end section including a pair of opposed slots and said second end section also including a pair of opposed slots;

said first end of said carrying handle including a first rod that extends through said pair of opposed slots of said first end section;

said second end of said carrying handle including a second rod that extends through said pair of opposed slots of said second end section;

said first rod is movable in said pair of opposed slots in said first end section and said second rod is movable in said pair of opposed slots in said second end section; and each of said slots including a detent, wherein when said carrying handle is moved from said retracted position to said extended position, said first rod and said second rod are moved in said respective pairs of opposed slots past said detents, said detents resisting movement of said first rod and said second rod and thus said carrying handle back into said retracted position.

10. The luggage article of claim 9, wherein said slots are generally arcuate in shape.

* * * * *